United States Patent [19]

Dragoset

[11] 4,039,897

[45] Aug. 2, 1977

[54] SYSTEM FOR CONTROLLING POWER APPLIED TO A GAS DISCHARGE LAMP

[76] Inventor: James E. Dragoset, 2006 Woodmont Drive, SE., Decatur, Ala. 35601

[21] Appl. No.: 664,965

[22] Filed: Mar. 8, 1976

[51] Int. Cl.[2] ..... H05B 37/00; H05B 39/00; H05B 41/14

[52] U.S. Cl. ..... 315/205; 315/208; 315/307; 315/287; 315/DIG. 5; 315/DIG. 7; 328/160; 324/142

[58] Field of Search ..... 324/142; 328/29, 30, 328/160; 315/DIG. 5, DIG. 7, 225, 226, 287, 209 R, 307, 299, 208, 205, 209

[56] References Cited

U.S. PATENT DOCUMENTS

| | | | |
|---|---|---|---|
| 3,471,747 | 10/1969 | Gershen | 315/DIG. 7 |
| 3,588,713 | 6/1971 | Yareck | 328/160 |
| 3,760,273 | 9/1973 | Burkett | 324/142 |
| 3,818,340 | 6/1974 | Yamaguchi | 324/142 |
| 3,890,537 | 6/1975 | Park et al. | 315/287 |

*Primary Examiner*—Saxfield Chatmon, Jr.

[57] ABSTRACT

A system for controlling power applied to a gas discharge lamp by an AC source, wherein the power dissipated in the lamp during a half cycle is sensed by a measuring circuit. The measuring circuit provides output signals proportional to the current through and voltage across the lamp during its conduction. The measuring circuit output signals are multiplied and the difference between the resultant multiplier signal and a reference signal is time integrated and fed to a pulse width modulator. The pulse width modulator provides a pulse to a pulse transformer to trigger an SCR in series with the lamp at some point in the next half cycle, the point at which the SCR is triggered being determined by the power dissipated in the lamp in the previous half cycle. In another embodiment the SCR is replaced by a transistor and the pulse width modulator shuts off the transistor after the lamp has dissipated the desired amount of power in a given half cycle.

10 Claims, 5 Drawing Figures

SYSTEM FOR CONTROLLING POWER APPLIED TO A GAS DISCHARGE LAMP

BACKGROUND OF THE INVENTION a. Field of the Invention

This invention relates to systems for controlling power dissipated in fluorescent and other gas discharge lamps.

b. Description of the Prior Art

It is known to utilize a ballast having a winding in series with a fluorescent lamp, the purpose of the ballast being to serve as a choke to prevent excessive current flow in the lamp. Disadvantages of such a system are that a significant amount of power is lost in the ballast and the use of the ballast increases the initial cost of the lamp.

It is also known to control current flow in fluorescent lamps by using a variable impedence in series with the lamp and utilizing a feedback signal to vary the value of the impedence as lamp current changes. One disadvantage of this system is that a significant amount of power is lost in the variable impedence.

It if further known to use feedback signals to control power applied to apparatus such as heaters, where the feedback signal may be generated by a thermocouple or by a thermistor connected in a bridge circuit. While such systems can be used to control power application over a period of time, they cannot be used to control power on a cycle-by-cycle basis.

SUMMARY OF THE INVENTION

A system for controlling power applied to a fluorescent or other gas discharge lamp wherein a measuring circuit provides output signals representing the voltage across and current through the lamp. The outputs of the measuring circuit are multiplied to produce a signal representing the power dissipated in the lamp in a half cycle and an integrating circuit integrates the difference between this signal and a reference signal to produce a signal which is fed to a pulse width modulator. The output of the pulse width modulator is fed through a pulse transformer to trigger a silicon controlled rectifier during the next two half cycles of the AC power supply. Increases over a desired value in the power dissipated in the lamp in a given half cycle cause the SCR to be triggered at a later point in each of the next two half cycles of the AC supply. Decreases under a desired value in the power dissipated in the lamp in a given half cycle cause the SCR to be triggered at earlier points in the next two half cycles of the AC supply. In a second embodiment of the invention the SCR is replaced by a transistor and the pulse width modulator shuts off the transistor when the lamp has dissipated the desired amount of power in a given half cycle.

DETAILED DESCRIPTION OF THE INVENTION

Figure 1:
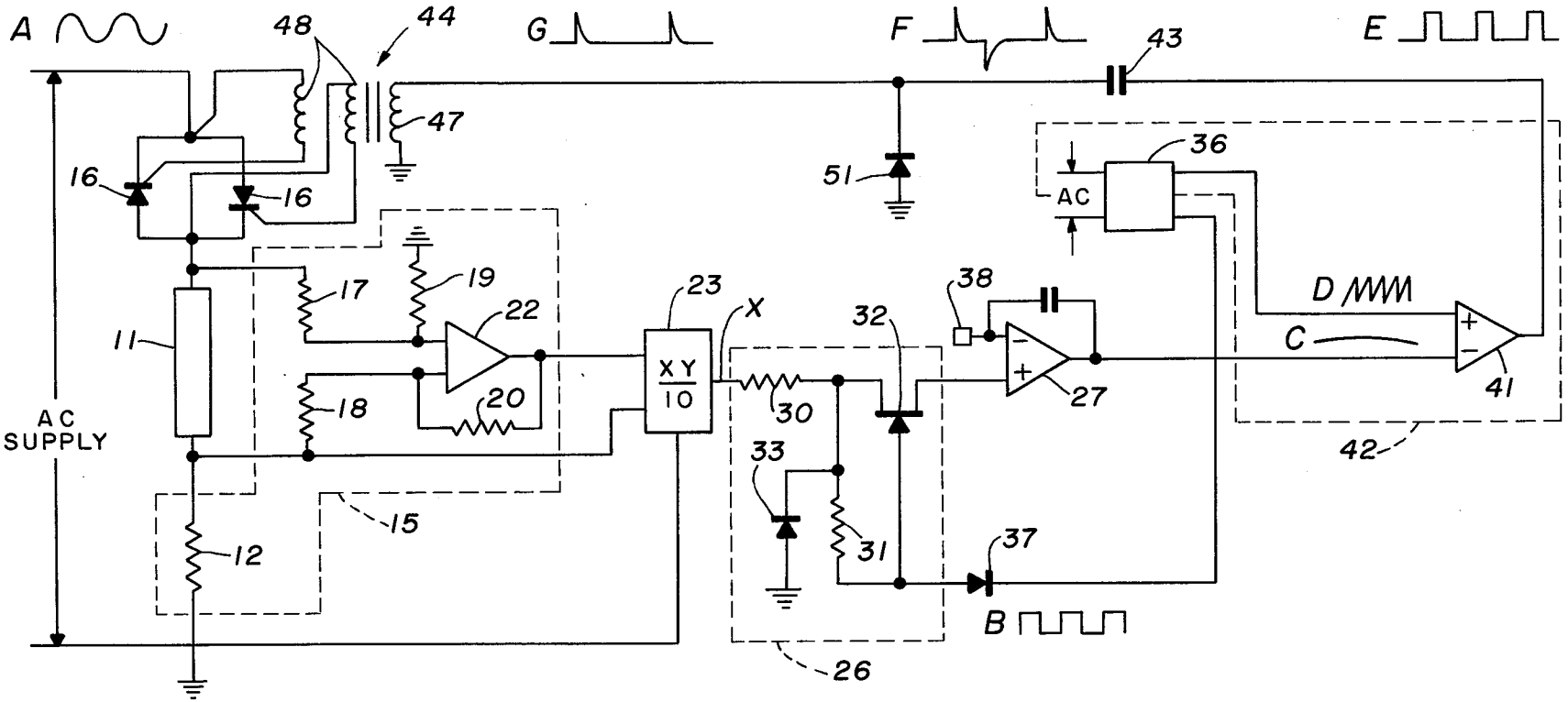
FIG. 1 shows the circuit of the present invention when SCR's are used to control power dissipated in the lamp.

Referring now in detail to the drawing, there is shown a conventional fluorescent lamp 11 connected in series with a voltage-dividing resistor 12 across an AC power supply. Also connected in series with the lamp 11 and the resistor 12 are two silicon controlled rectifiers 16, connected in parallel as shown in the drawing. The purpose of the SCR's 16 is to control the amount of power being applied to the lamp 11 during each half cycle, one of the SCR's conducting on positive half cycles and the other on negative half cycles.

A sensing or measuring network 15 connected across the lamp 11 is used to measure the instantaneous voltage across and current through the lamp 11 during a given half cycle and produce signals proportional to each, the voltage-dividing resistor 12 being considered as part of the sensing or measuring network 15. The measuring network 15 includes resistors 12, 17, 18, 19 and 20 and a difference amplifier 22 of a conventional type connected as shown in th drawing. The values of the resistors 17–20 are such that the output signals of the measuring network 15 are relatively low.

The resistors 17 and 19 divide to ground the voltage appearing above the lamp 11, one input of the amplifier 22 being connected to a point between the resistors 17 and 19 so that this input is connected through the resistor 17 to one end of the lamp. The other input to the difference amplifier 22 is connected through the resistor 18 to the other end of the lamp 11. This provides an input signal to the amplifier 22 proportional to the voltage across the lamp 11, the amplifier 22 then producing a first output or voltage signal proportional to the voltage across the lamp 11 during its conduction. The resistor 20, connected across the amplifier 22 as shown, is a feedback resistor.

The purpose of the resistor 12 is to provide a voltage slightly above ground which can be used as an indication of current flow through the lamp 11 connected in series with the resistor 12. The resistance value of the resistor 12 is on the order of $\frac{1}{2}$ to 1 ohm, so that it will dissipate very little power. The voltage appearing at a point between the resistor 12 and the lamp 11 will be proportional to the current flowing through the lamp 11 during its conduction. This voltage serves as the second output signal, or current signal, of the sensing network 15.

The output signals of the sensing network 15 are fed into a single quadrant XY multiplier 23 of a conventional type. The multiplier 23 is such that its output signal will be the product of the two input signals from the sensing network 15, divided by 10. The multiplication of the current and voltage signals from the network 15 produces a multiplied or product signal which is proportional to the power dissipated in the lamp.

The output of the output of the multiplier 23 is fed through a switching network 26 to a difference integrator 27, the purpose of the switching network 26 being to insure that only valid multiplier output (i.e., both multiplier inputs are non negative) signals are fed to the integrator 27. The switching network includes a load resistor 30, a biasing resistor 31, a field effect transistor 32 and a diode 33 connected as shown. The purpose of the diode 33 is to ground any negative signals from the multiplier 23. The field effect transistor serves as a switch which is turned on and off in timed relationship with the AC supply so that only valid multiplier signals (when the AC line is positive and both outputs of the sensing network are positive) are fed to the difference integrator. The switching network 26 can be dispensed with if a multiple quadrant multiplier is used. For economy reasons a single quadrant multiplier is preferred.

Figure 2:
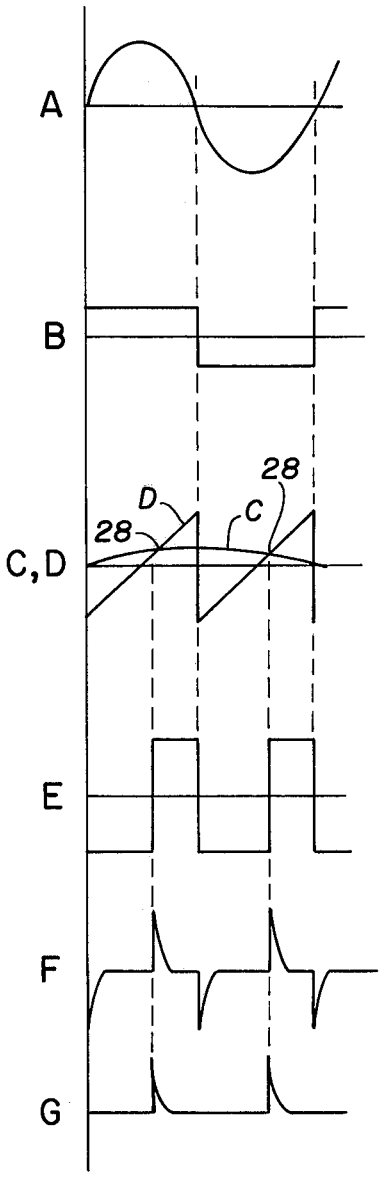
FIG. 2 shows the wave forms of the signals appearing at various points in the circuit of FIG. 1, as well as showing the phase relationship of these signals with the AC line supply.

A signal generator 36 having an AC input in phase with the AC line supply provides a first output having a square wave configuration, shown as B in FIG. 2, which is fed through a diode 37 to turn the FET 32 on and off in synchronism with the AC line supply.

The difference integrator 27 compares the difference in voltages from the switched multiplier 23 and a DC reference source 38 and provides an output signal C proportional to the time-integrated difference between these two voltages, the output signal being fed into a high gain amplifier 41 of a conventional type. Also fed into the amplifier 41 is a sawtooth signal D obtained from the signal generator 36, this signal being syncrhonized with AC line voltage as shown by the wave forms in FIG. 2. The output voltages of both the signal generator 36 and the integrator 27 are bounded in a conventional manner for controlling the amplitudes of these two outputs to prevent the integrator output from exceeding the maximum and minimum values of the sawtooth wave. This bounding may be accomplished internally of the signal generator 36 and the integrator 27 by the use of Zener diodes connected back-to-back. The vertical portions of the sawtooth wave occur at the points where the AC line supply voltage passes through zero, as shown in FIG. 2.

The amplifier 41 compares the voltage of the sawtooth signal D from the generator 36 and the voltage of the signal from the integrator 27 and puts out a modulated trigger or actuating signal E each time the voltage of the signal from the generator 36 becomes positive with reference to the voltage of the signal from the integrator 27, this point being indicated by reference numeral 28 in FIG. 2. The output signal E of the amplifier 41 is a square wave which is positive when the signal from the generator 36 is positive with reference to the voltage of the signal from the integrator 27 and which is negative when the voltage of the signal from the generator 36 is equal to or negative with respect to the voltage of the signal from the integrator 27.

The amplifier 41 and that part of the signal generator which produces the sawtooth wave act as a pulse width modulator 42 in that the length of each pulse from the amplifier 41 is modulated or varied in response to the power dissipated in the lamp. If the power dissipated in the lamp 11 varies from the desired amount the output pulses from the amplifier 41 will change in length in order to adjust the firing time of the SCR's, relative to the AC power supply, to bring the power dissipated in the lamp back to the desired value.

The output of the amplifier 41 is passed through a capacitor 43 to a pulse transformer 44 having a primary winding 47 and two secondary windings 48. The capacitor 43 converts the square wave output of the amplifier 41 to a series of positive and negative pulses F as shown in the drawing. A diode 51 connected to ground clips the negative pulses to leave only positive pulses G, which fire the silicon controlled rectifiers 16 to allow the lamp 11 to conduct.

FIG. 2 shows the wave forms appearing at various points in the circuit. Wave form A is the AC supply. The timing of signals B-G relative to the AC supply voltage A will readily be apparent from FIG. 2.

With a 60 cycle AC line supply the interval between adjacent positive trigger pulses G will be about 1/120th of a second, so that the SCR's 16 are triggered on each half cycle of the AC line supply. The time interval between adjacent trigger or actuating pulses G is controlled by the amount of power dissipated in the lamp 11 on a previous half cycle. For example, if more power is dissipated in the lamp 11 than is desired on the given half cycle the difference in input signals to the integrator 27 will become greater, thereby making the output signal C of the integrator 27 to the amplifier 41 more positive. With the input from the integrator 27 becoming more positive, more time will be required for the sawtooth input D from the signal generator 36 to become positive with reference to the signal C from the integrator 27. This delays th next positive pulse E sent to the pulse transformer to thereby delay the firing point of the SCR's in the next half cycle so that the power consumed in the lamp is reduced toward the desired value in the next half cycle.

Since the inputs to the integrator 27 and its output signal C do not change rapidly, the measuring of power dissipated in the lamp will, in a given half cycle, serve to control the firing of the SCR's in the next several half cycles. Thus, it is not necessary to measure lamp power in every half cycle.

In operation, the measuring network 15 measures the voltage across and current through the lamp 11 and provides output signals to the multiplier 23 which computes the power dissipated in the lamp by multiplying the current and voltage signals. The output of the multiplier 23, which is proportional to the power dissipated in the lamp 11, is fed through the switching network 26 to the difference integrator 27 where it is compared to a reference signal from the DC supply 38. The difference between these two inputs is integrted and fed as signal C into the amplifier 41, along with the sawtooth signal D from the signal generator 36. Each time the sawtooth signal from the signal generator 36 becomes positive with respect to signal C a modulated trigger pulse E is sent to the SCR's to allow the lamp 11 to conduct. Generally, the SCR's will be triggered at an actual line voltage of about 120 to 125 volts and the lamp will then conduct until the line voltage falls below that value necessary for conduction through the lamp. The amount of power dissipated in the lamp 11 can be adjusted by changing the value of the DC reference signal from the supply 38.

Figure 3:
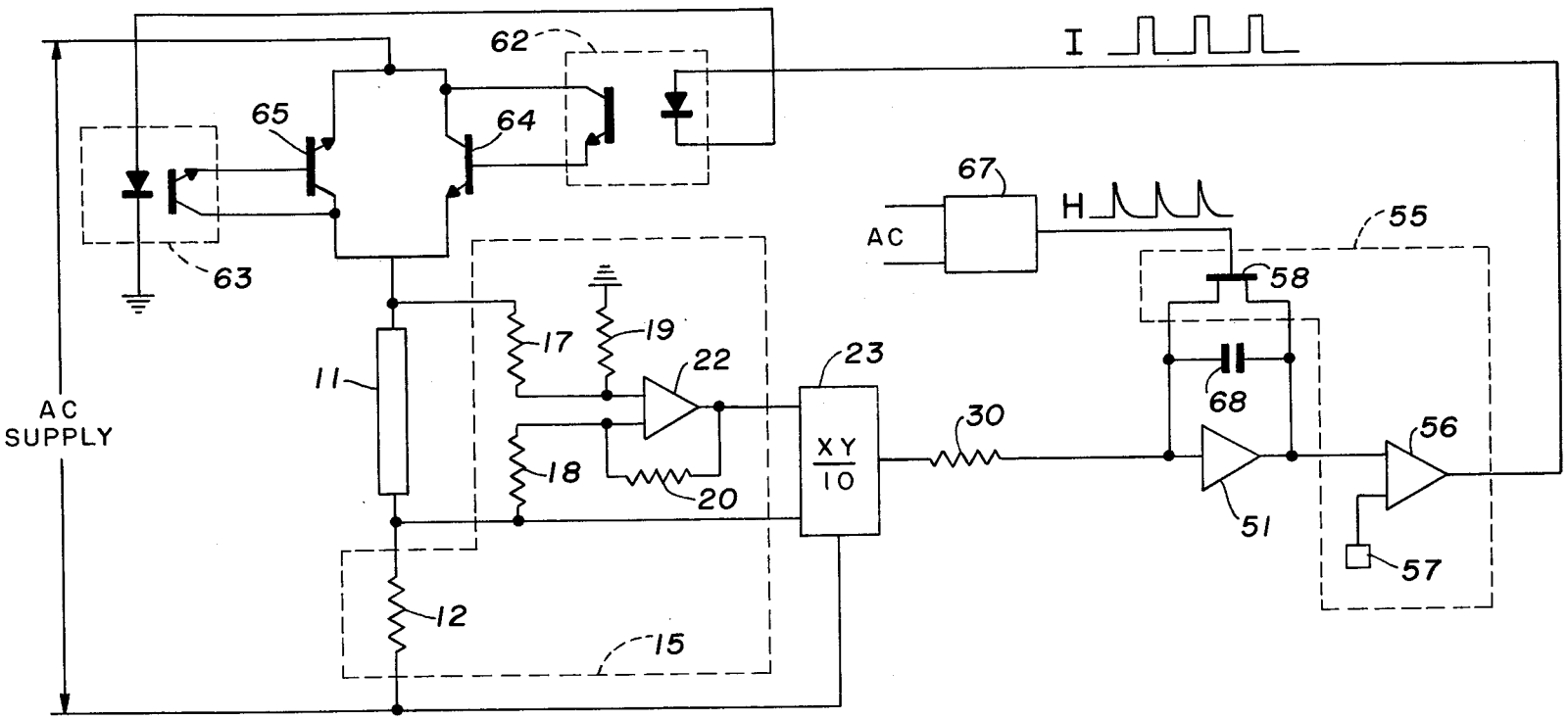
FIG. 3 shows another embodiment of the circuit of the present invention using transistors instead of SCR's.

In a second embodiment of the invention, shown in FIG. 3, transistors are used instead of SCR's. In this embodiment the multiplier output signal is fed through the load resistor 30 to a re-settable integrator 51. The integrator 51 integrates the multiplied or product signal and produces an output signal which is fed to a pulse width modulator 55 which produces an output signal I. The pulse width modulator 55 includes an amplifier 56, a DC source 57 and the re-settable portion of the integrator, a field effect transistor 58.

The modulated output signal I of the amplifier 56 is fed through a pair of optical isolators 62 and 63 connected in series to control transistors 64 and 65 connected in series with the lamp 11 to allow current from the AC supply to flow through these transistors and the lamp 11. The optial isolators 62 and 63 are well known components which are used to provide electrical isolation between the trigger or actuating circuit and the transistors. The transistors 64 and 65 are connected in such a manner that one of them conducts on positive half cycles and the other conducts during negative half cycles.

Figure 4:
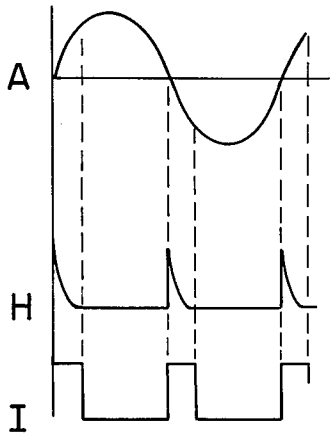
FIG. 4 shows the phase relationship between the AC line supply and signals which appear at various points in the circuit of FIG. 3.

In this embodiment the lamp 11 will begin to conduct in each half cycle at some line voltage, referred to herein as "lamp conduction voltage," which is sufficient to cause lamp conduction and the sensing network 15 will measure power dissipated in the lamp. When the desired amount of power has been dissipated in the lamp 11 the multiplier output signal will act through the integrator 51 and the pulse modulator 55 to shut off the transistors 64 and 65 so that no more current can flow through the lamp 11 during that half cycle. Following cutoff of the transistors 64 and 65 the integrator 51 is reset by means of a signal H from an AC operated signal generator 67, the output H of the signal generator 67 being a series of positive pulses timed with the AC power supply and having the wave form shown in FIG. 4. Each of the positive pulses renders the field effect transistor 58 conductive to thereby short out a capacitor 68 and reset the integrator 51 so that it will be ready for the multiplier signal in the next half cycle, the generator 67 being synchronized with the AC line supply to short out the capacitor 68 each time the AC supply voltage passes through zero (FIG. 4). The power dissipated in the lamp 11 in this embodiment can be adjusted by changing the value of the DC signal from the supply 57.

FIG. 4 shows the signal H used to re-set the integrator 51 and the signal I used to control the transistors 64 and 65. The timing of these signals relative to the AC supply voltage A will readily be apparent from FIG. 4.

Figure 5:
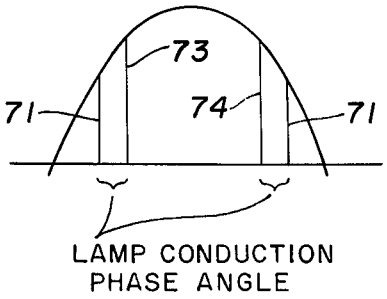
FIG. 5 shows the periods in a half cycle of the AC power supply during which current flows through the lamp in the two embodiments of the invention.

FIG. 5 shows the periods of conduction of the lamp 11 in a given half cycle when each of the two embodiments of the invention are used. The vertical lines 71 represent the point at which the changing AC line voltage is just sufficient to cause conduction through the lamp 11, this being the lamp conduction voltage. The lamp will not conduct below this voltage. The vertical line 73 represents the point at which the circuit will act to cut off the transistors 64 and 65, with the distance between the lines 71 and 73 representing the time interval, or power supply phase angle, during which the lamp 11 will be allowed to conduct when transistors are used to control lamp power. The vertical line 74 represents the point at which the SCR's will be triggered or actuated in the embodiment utilizing SCR's, with the distance between the lines 74 and 71 representing the time interval, or power supply phase angle, during which the lamp 11 will be allowed to conduct in the embodiment utilizing SCR's.

If more power is dissipated in the lamp 11 than is desired the lines 73 and 74 will more toward the adjacent line 71 to thereby decrease the power supply phase angle during which the lamp 11 is allowed to conduct. On the other hand, if the amount of power dissipated in the lamp 11 is below that desired, the lines 73 and 74 will move away from the adjacent line 71 to increase the time interval or power supply phase angle during which the lamp 11 is allowed to conduct.

The system of the present invention does not require a ballast or any type of power dissipating impedence connected in series with the lamp, other than the resistor 12. Conventional lamp starting methods can be used with this system.

What is claimed is:

1. A system for controlling power dissipated in a gas discharge lamp powered by an AC supply, comprising a. a semi-conductor adapted to be rendered conductive by an actuating pulse, said semi-conductor and said lamp being connected in series across the AC power supply, b. a measuring network connected to the lamp for measuring voltage across and current through the lamp in a given half cycle of the AC power supply and for providing output signals proportional to said voltage and current, c. means connected to the measuring network for multiplying said output signals and providing a multiplied signal, d. means connected to the multiplying means for integrating said multiplied signal and providing an integrated output signal, and e. means synchronized with the AC power supply and connected to the integrating means for actuating the semi-conductor to adjust the time interval in a subsequent half cycle during which the lamp is allowed to conduct, said adjustment being made in response to power dissipated in the lamp in said given half cycle.

2. The system of claim 1 wherein the measuring network includes an impedence connected in series with the lamp and means for amplifying the voltage across the lamp, said multiplying means being connected to receive a voltage signal from the amplifying means and a current signal from a point connected between the lamp and said impedence.

3. The system of claim 2 wherein the system includes a DC reference source connected as an input to the integrating means, said integrating means integrating the difference between the multiplied signal and said DC reference source.

4. The system of claim 3 wherein the pulse width modulator comprises an amplifier and means synchronized with the AC power supply for generating a sawtooth signal, said amplifier being connected to amplify the difference between the signal from the integrating means and said sawtooth signal to provide an actuating signal to the semi-conductor, said semi-conductor being a silicon controlled rectifier.

5. The system of claim 2 wherein the pulse width modulator includes an amplifier and a DC reference source, said amplifier being connected to amplify the difference between the DC reference source and the output signal of the integrating means for providing an actuating signal to the semi-conductor, said semi-conductor being a transistor.

6. A system for controlling power dissipated in a gas discharge lamp powered by an AC power supply, comprising a. a resistor connected in series with the lamp, said resistor being connected between the lamp and ground, b. a first amplifier connected across the lamp for amplifying the voltage across the lamp to provide a voltage signal, c. a multiplier having one input connected to the first amplifier and another input connected to the end of the lamp adjacent to the resistor for providing a multiplied signal, d. a DC reference source, e. a difference integrator connected to integrate the difference between the DC reference source and the multiplied signal and provide an integrated signal, f. a switch connected between the multiplier and the integrator, g. means connected to the switch for turning said switch on and off in timed relationship to the AC power supply, h. means for generating a sawtooth signal, said sawtooth signal being synchronized with the AC power supply, i. a second amplifier connected to compare the sawtooth signal and the integrated signal and produce a positive pulse each time the sawtooth signal becomes positive with respect to the integrated signal, j. means connected to the amplifier for converting said positive pulses to spaced positive signals, and k. a silicon controlled rectifier connected in series with the lamp and adapted to be triggered by said spaced positive pulses.

7. The system of claim 5 wherein the switch is a field effect transistor and the means for turning the switch on is a signal generator.

8. The system of claim 7 wherein a pulse transformer is connected between the second amplifier and the silicon controlled rectifier.

9. The system of claim 8 wherein a pair of silicon controlled rectifiers are connected in parallel with each other and in series with the lamp, one of said rectifiers being connected to conduct during positive half cycles of the AC power supply and the other said rectifier being connected to conduct during hegative half cycles of said power supply.

10. A system for controlling power dissipated in a gas discharge lamp powered by an AC power supply, comprising a. a resistor connected in series with the lamp, b. a first amplifier connected across the lamp for amplifying the voltage across the lamp to provide a voltage signal, c. a multiplier having one input connected to the first amplifier and another input connected to the end of the lamp adjacent to the resistor for providing a multiplied signal, d. a re-settable integrator connected to recive and integrate the multiplier signal to provide an integrated signal, e. a signal generator synchronized with the AC power supply and connected to the integrator for re-setting said integrator in timed relationship with said AC power supply, f. a DC reference source, g. a second amplifier connected to the DC reference source and the integrator for comparing the integrated signal with said reference source and providing an actuating signal, and h. a pair of transistors connected in parallel with each other and in series with the lamp, one of said transistors being connected to conduct during positive half cycles of the power supply and the other transistor being connected to conduct during negative half cycles of said power supply, said transistors being connected to the second amplifier for receiving said actuating signals.

* * * * *